US011793690B2

(12) United States Patent
Richer et al.

(10) Patent No.: US 11,793,690 B2
(45) Date of Patent: Oct. 24, 2023

(54) ACCESSIBLE SCOOTERS AND METHODS OF USE

(71) Applicant: Ford Global Technologies, LLC, Dearborn, MI (US)

(72) Inventors: Benjamin Richer, Ann Arbor, MI (US); Heath Ahlers, Dearborn, MI (US); Emily Obert, Ferndale, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 128 days.

(21) Appl. No.: 17/543,594

(22) Filed: Dec. 6, 2021

(65) Prior Publication Data

US 2023/0172777 A1 Jun. 8, 2023

(51) Int. Cl.
*A61G 5/00* (2006.01)
*A61G 5/10* (2006.01)

(52) U.S. Cl.
CPC ..... *A61G 5/003* (2013.01); *A61G 5/1051* (2016.11)

(58) Field of Classification Search
CPC ..... A61G 5/047; A61G 5/003; A61G 5/1051; A61G 5/00
USPC ..... 280/32.7
See application file for complete search history.

(56) References Cited

U.S. PATENT DOCUMENTS 5,036,938 A * 8/1991 Blount ..... B62D 61/08 180/68.5
5,494,126 A * 2/1996 Meeker ..... A61G 5/047 180/907
6,766,871 B2 * 7/2004 Sawyer ..... A61G 5/047 180/211
7,174,093 B2 * 2/2007 Kidd ..... A61G 5/047 310/67 R
9,908,554 B2 * 3/2018 Corning ..... B62B 13/046
10,076,457 B2 * 9/2018 Behm ..... A61G 5/1005
10,407,117 B2 * 9/2019 Allais ..... B62K 3/002
10,751,232 B1 * 8/2020 Ilao ..... A61G 5/1051
10,857,046 B2 * 12/2020 Kim ..... A61G 5/047
10,888,474 B2 * 1/2021 Kim ..... A61G 5/047
2005/0238337 A1 * 10/2005 Kidd ..... A61G 5/1051 388/838
2008/0315549 A1 * 12/2008 Dougherty ..... A61G 5/06 280/250.1

(Continued)

FOREIGN PATENT DOCUMENTS

CA 2369382 A1 7/2003
CN 104648562 A 5/2015
KR 20160049778 A 5/2016

OTHER PUBLICATIONS

Raj, Best Electric Mobility Car for Wheelchair Users | Kenguru, TheSUPERBOO! Cool Inventions | Uncommon Gadgets, Sep. 3, 2019, 1-10.

*Primary Examiner* — James A Shriver, II
*Assistant Examiner* — Hilary L Johns
(74) *Attorney, Agent, or Firm* — Brandon Hicks; Eversheds Sutherland (US) LLP

(57) ABSTRACT

Accessible scooters and methods of use are disclosed herein. An example scooter can include a scooter base that is adapted to interface with a frame of a wheelchair, a locking mechanism associated with the scooter base, the locking mechanism releasably securing the frame of a wheelchair to the scooter base, and a steering column associated with handlebars of the scooter.

20 Claims, 6 Drawing Sheets

(56) References Cited

U.S. PATENT DOCUMENTS

| | | | | |
|---|---|---|---|---|
| 2011/0095508 | A1* | 4/2011 | Chiu | A61G 5/047 280/304.1 |
| 2011/0158778 | A1* | 6/2011 | Harrington | B65G 69/003 414/401 |
| 2017/0029058 | A1* | 2/2017 | Allais | B62J 25/04 |
| 2017/0190335 | A1* | 7/2017 | Gillett | B62K 17/00 |
| 2018/0338877 | A1* | 11/2018 | Kano | B62K 15/00 |
| 2020/0000658 | A1* | 1/2020 | Klein | A61G 5/047 |
| 2021/0052444 | A1* | 2/2021 | Diamond | B60K 17/043 |
| 2021/0212870 | A1* | 7/2021 | Hodsdon | B62K 11/02 |

* cited by examiner

ACCESSIBLE SCOOTERS AND METHODS OF USE

BACKGROUND

The usability of scooters by customers with disabilities is a concern. For example, manual wheelchair users have many of the same struggles as pedestrians, and even more so when attempting to use point-to-point transportation such as scooters or e-scooters. Wheelchair users have an extra challenge of negotiating around scooters parked on the sidewalk. Making scooters more accessible can help offset the frustration that wheelchair users feel due to this new obstacle.

The use of scooters for wheelchair users involves a series of problems that prevent them from being accessible. The scooters are designed for users to be able to stand and balance. For a wheelchair user who is seated, this prevents access to a form of transportation. While some workarounds have been attempted, they do not provide the stability or ergonomic comfort that scooters provide for standing riders. Users do not have a means to securely attach a wheelchair to the scooter.

BRIEF DESCRIPTION OF THE DRAWINGS

A detailed description is set forth regarding the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
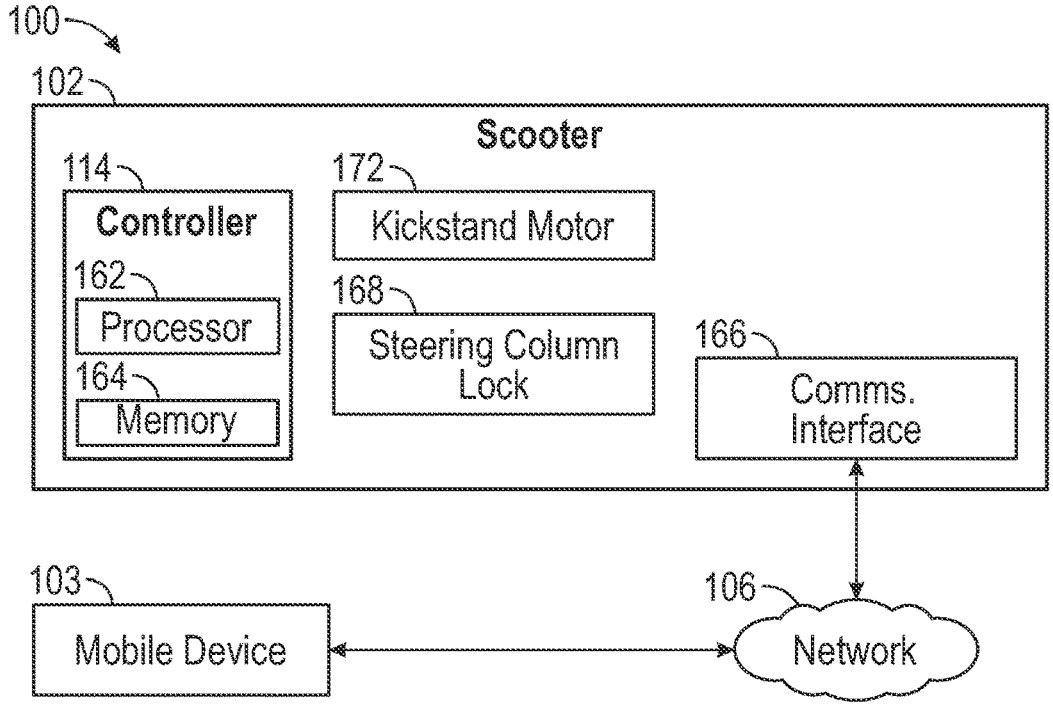
FIG. 1 illustrates an example electric scooter with accessible features.
Figure 1:
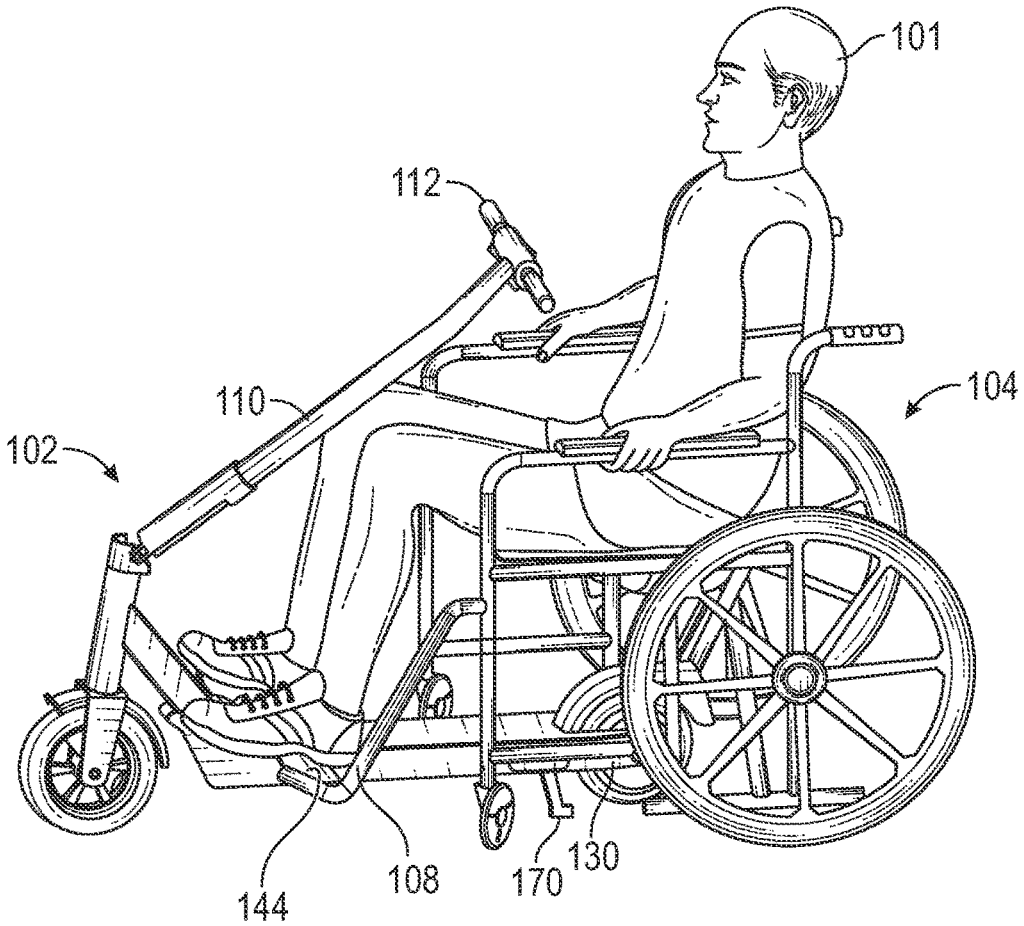

The present disclosure pertains to mobility enhanced scooters and methods of use. One example scooter includes a three-wheeled device that integrates a locking mechanism that controls how a wheelchair is attached, a tilt adjustment mechanism that allows for selective positioning of the steering handles, and associated modifications to control and operation.

An example wheelchair can include a full, rigidly attached footplate. At the base of a steering column, the scooter would have a hook that could be used as a stop for the front of the footplate. When a user approaches the scooter, they would lift the footplate over a rear wheel(s) of the scooter and onto a deck of the base of the scooter. Using the stability of the flat deck on the three-wheeled design and the handlebars, the user would bring the footplate forward on the scooter until it hits the stop-hook at the front.

Through either a limit switch on the stop-hook or command through an associated mobile application, which connects to the scooter through BLUETOOTH or WiFi, a controller of the scooter would recognize the presence of a wheelchair onboard. This would trigger a locking lever to hinge up from a deck of the scooter until the locking lever securely presses on the back of the footplate, creating a grip to attach the wheelchair to the scooter. This hook/lever would be wide enough to provide rotational forces to turn the wheelchair and provide enough friction to prevent the footplate to slide to the side while turning.

The scooter would include a tilt adjustment mechanism associated with the upright steering column that allows the handlebar height to be adjusted between various angles. One example angle would be upright to use as handlebars for standing riders, as is common today. A second example angle would lower the handlebars towards a seated rider in the wheelchair. Once the footplate has been locked in place, the handlebar collar would unlock so the rider could lift the collar and pull the handlebars down, at which point the collar would re-lock the steering column at the lower set point. In one example configuration, the tilt adjustment mechanism is placed at a pivot point for the steering column. The tilt adjustment mechanism can comprise a universal joint to allow for steering at multiple angles.

Most scooters today do not engage the motor from a complete stop, but when set up with a wheelchair attached, this control should be released to aid in starting because kicking off is not feasible for a wheelchair user. After a ride, the rider should be able to indicate they are finished with the ride using either a control on the scooter or through the mobile application. This trigger would release the hook on the locking lever to allow the user to remove the wheelchair from the scooter and release the collar to allow the handlebars to be returned to the upright position. This would remain unlocked until the next use to allow the next user to return the handlebars to upright if it is not done during offboarding.

For a two-wheeled scooter, an additional change is incorporated to address a kickstand. When the user indicates they have engaged their wheelchair with the scooter, a motor can automatically raise a kickstand. At the end of the ride, the same motor can be controlled to lower the kickstand before releasing the locking lever. The solution to lowering the handlebars may also be used to reduce the height of the scooters for ease of storage or transportation.

Illustrative Embodiments

Turning now to the drawings, FIG. 1 depicts an illustrative architecture 100 in which techniques and structures of the present disclosure may be implemented. The architecture 100 includes an electronic scooter (hereinafter "scooter 102"), a wheelchair 104, and a network 106. The network 106 can include combinations of networks. For example, the network 106 may include any one or a combination of multiple different types of networks, such as cellular, cable, the Internet, wireless networks, and other private and/or public networks. The network 106 can include either or both short and long-range wireless networks.

The wheelchair 104 can be operated by a user 101. The user 101 can position the wheelchair 104 over the scooter 102. The user 101 can couple and/or decouple the wheelchair 104 with the scooter 102 in various ways as disclosed herein. In some instances, the user 101 can interact with a controller (disclosed infra) of the scooter using a mobile device 103. For example, the user 101 can engage with an application installed on the mobile device 103 to request use of the scooter 102. The user 101 can identify or request mobility service features of the scooter 102 through the application.

Figure 2A:
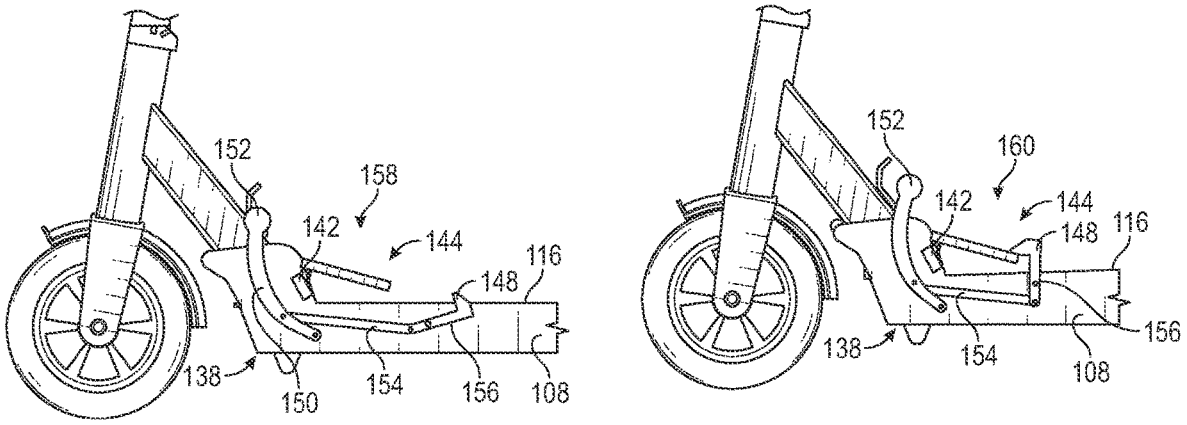
FIG. 2A illustrates an example locking mechanism in the form of a manual mechanical linkage assembly.
Figure 2B:
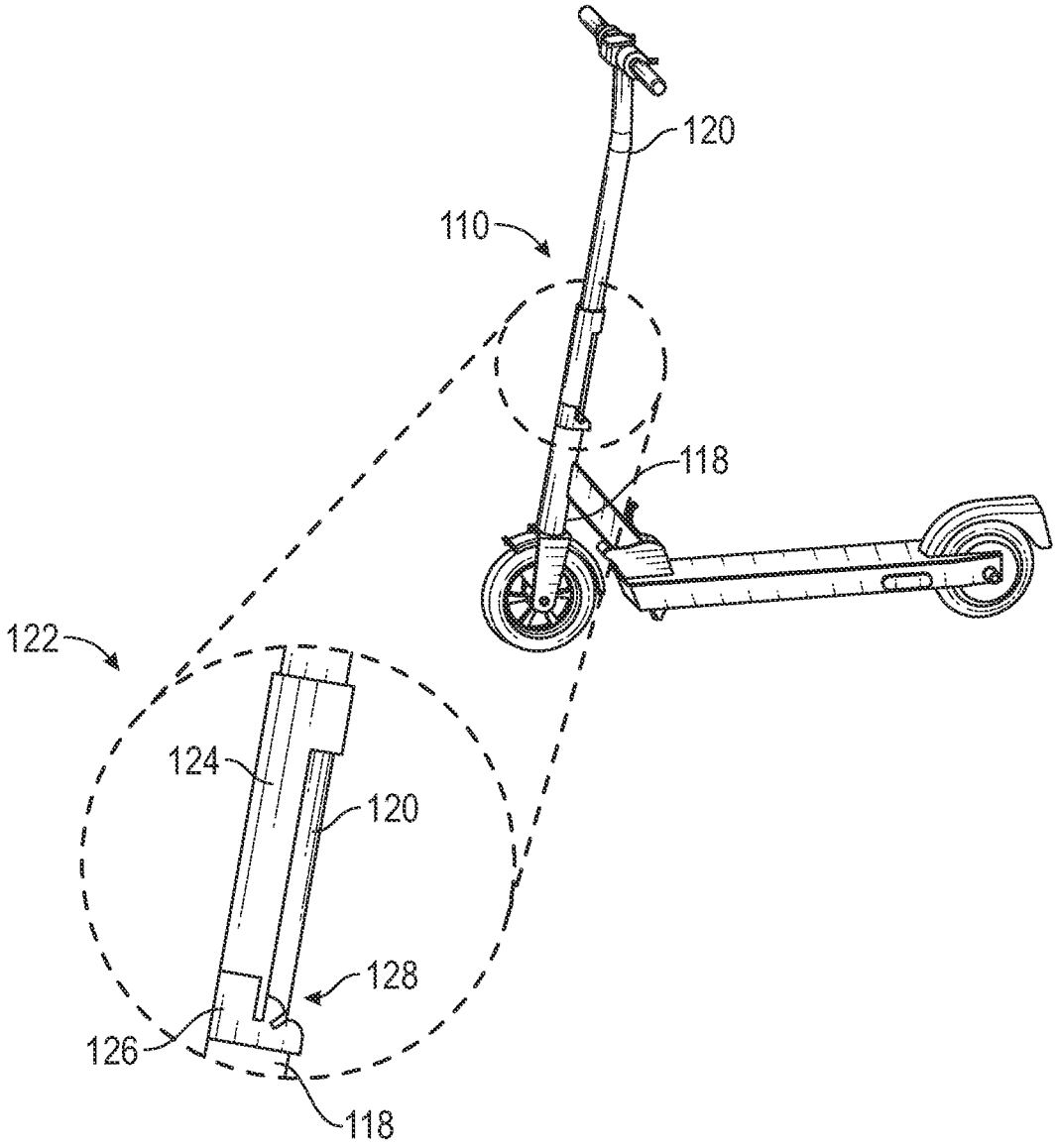
FIG. 2B illustrates an example tilt adjustment mechanism for a steering column of a scooter.

Referring collectively to FIGS. 1-2B, the scooter 102 includes a scooter base 108, steering column 110, handlebars 112, and a controller 114. The scooter base 108 can be coupled to two or more wheels. For example, the scooter base can be coupled to a front wheel and a rear wheel. In some instances, there may be tandem rear wheels. The scooter base 108 has a substantially flat deck 116 that a user can stand upon.

The steering column 110 is comprised of two portions. A lower portion 118 is fixed and can be coupled to the scooter base 108. An upper portion 120 is coupled to the handlebars 112 and can be rotated as the handlebars are rotated. The upper portion 120 is coupled to the front wheel and transfers the rotation of the handlebars into the corresponding turning of the front wheel. The upper portion 120 extends through the lower portion 118. The lower portion 118 acts as a sleeve that surrounds the upper portion 120. In some instances, the upper portion 120 can be divided into two sections, which are connected via a u-joint or other similar linkage.

The scooter 102 can comprise a tilt adjustment mechanism 122 that allows the handlebars 112 to be placed in an advantageous position for a user of a wheelchair. The tilt adjustment mechanism 122 can comprise an upper collar 124 and a lower collar 126. The lower collar 126 can be coupled to the lower portion 118 of the steering column 110 and the upper collar 124 mates with the upper portion 120 of the steering column. In one example, the upper collar 124 and lower collar 126 are resiliently coupled together. For example, the upper collar 124 and lower collar 126 can be coupled together with a spring. In general, the lower collar and the upper collar are resiliently coupled with one another in such a way that when a user pulls the upper collar away from the lower collar, the lower portion of the steering column and the upper portion of the steering column separate from one another allowing the steering column to pivot or tilt.

The lower collar comprises position grooves 128 that correspond to distinct tilt positions for the steering column 110. When the user releases the upper collar 124, the upper collar 124 can move towards the lower collar 126 due to spring action. When the steering column 110 has been tilted, the upper collar 124 can engage with the position grooves of the lower collar 126, allowing the steering column 110 to be locked, temporarily, into the tilted position. That is, when the user releases the upper collar, the upper collar is adapted to seat into one of the position grooves of the lower collar to secure the steering column in a tilted position.

Referring now to FIG. 2, the scooter 102 can also comprise a locking mechanism 138 that releasably secures the wheelchair 104. The locking mechanism 138 can comprise a stop mechanism 140 that could include a bumper. When the wheelchair 104 is positioned over the scooter 102, a footplate 144 of the wheelchair 104 can contact the stop mechanism 140. In one configuration, the stop mechanism 140 includes a sensor 142 that detects pressure from the footplate 144 of the wheelchair 104. The stop mechanism 140 can be operatively coupled to a mechanical linkage assembly in some instances. Engagement or disengagement of the footplate 144 of the wheelchair 104 with the stop mechanism 140 can effectuate operation of the mechanical linkage assembly. In other instances, the stop mechanism 140 is a fixed, arcuate bracket that is separate from the mechanical linkage assembly. The stop mechanism 140 engages with a front of the footplate 144 of the wheelchair 104.

The mechanical linkage assembly may include a hook 148 that is configured to engage with the footplate 144 of the wheelchair 104. The mechanical linkage assembly comprises a first linkage 150 having a handle 152. The first linkage can be connected to a second linkage 154 that is in turn coupled to a third linkage 156 comprising the hook 148. In some instances, the stop mechanism 140 could be coupled to the mechanical linkage assembly. When the footplate 144 of the wheelchair 104 pushes against the stop mechanism 140, the mechanical linkage assembly transfers the force through the linkages, causing the hook 148 to raise and engage with a frame 130 of the wheelchair or the footplate 144 of the wheelchair 104. As noted above, the hook/lever would be wide enough to provide rotational forces to turn the wheelchair and provide enough friction to prevent the footplate from sliding to the side while turning of the handlebars/front wheel.

In another configuration, a user uses the handle 152 to shift the hook 148 from an open position 158 to a closed position 160. For example, the user can push the handle 152 forward to place the hook 148 in the open position 158 and pull the handle 152 towards the user to place the hook 148 in the closed position 160.

The hook 148 can be positioned proximately to a deck of the scooter base when in the closed position allowing the footplate 144 of the wheelchair 104 to move past the hook 148, the hook pivoting upwardly to engage with the frame 130 or the footplate 144 of the wheelchair 104 when in the closed position 160.

As noted above, a user of the wheelchair 104 that desires to use the mobility services of the scooter 102 can request such use through an application on their mobile device. The application can be used to communicate with the controller 114 of the scooter 102. The controller can comprise a processor 162 and memory 164. The processor 162 executes instructions stored in memory 164 to perform any of the methods disclosed herein. When referring to actions performed by the controller 114, it will be understood that this includes execution of instructions by the processor 162. The scooter 102 can comprise a communications interface 166 that allows the controller 114 to access the network 106 and/or communicate directly with the mobile device of the user.

For example, the controller 114 of the scooter can receive signals from the limit switch or sensor 142 that indicate that the footplate of the wheelchair is in contact with the mechanical stop 140. The controller 114 can also unlock the tilt adjustment mechanism 122 of the scooter. For example, an electronically activated steering column lock 168 can be operated by the controller 114. In one example, the lock 168 can include a pin that is moved in/out of a hole in the steering column by a solenoid. In some instances, the controller 114 can deploy or retract a kickstand 170 (see FIG. 1) of the scooter. The kickstand 170 can be actuated by a kickstand motor or solenoid 172 that can be operated by the controller 114.

The controller 114 can also be configured to selectively adjust operational parameters for the scooter when the user has selected a mobility or accessibility option. For example, it is implicit that wheelchair users may not have the ability to initiate movement of the scooter 102 with their feet. It is common for a scooter to require some initial propulsion from a user before engaging a motor of the scooter for power. In instances where the mobility option has been selected, the controller 114 can adjust a throttle profile of the scooter 102 such that when the user engages a throttle control on the handlebars 112, the motor of the scooter immediately engages to provide propulsion power to the wheels of the scooter. This reduces and/or eliminates the need for the user to push or otherwise propel the scooter forward to initiate powered movement.

Figure 3:
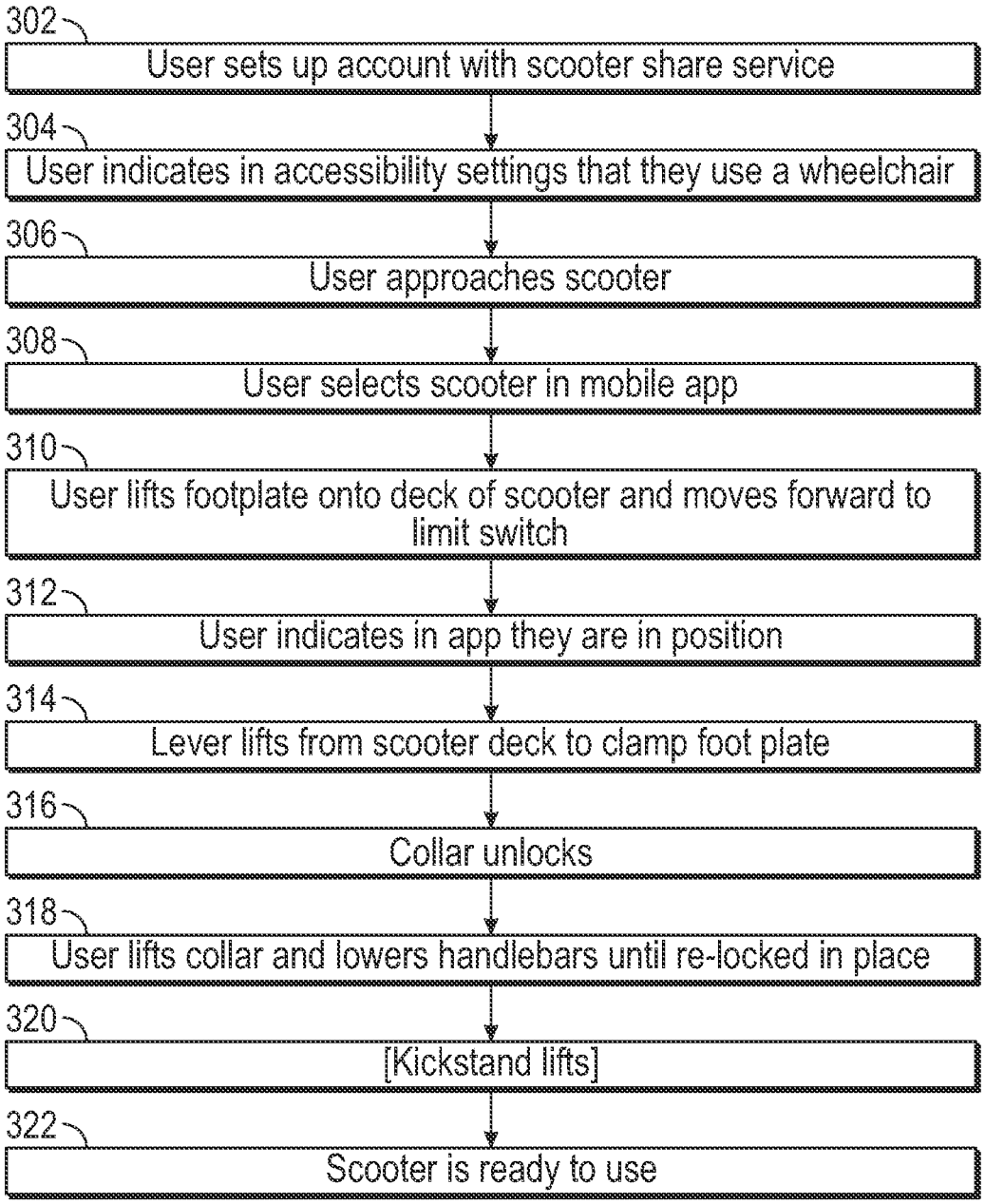
FIG. 3 is a flowchart of an example method of the present disclosure.

Referring now to FIG. 3, which is a flowchart of an example on-boarding method of the present disclosure. In step 302, a user establishes an account with a scooter-sharing service. Next, in step 304, the user requests accessibility services and acknowledges that they use a wheelchair. In step 306, the user approaches the scooter and in step 308, the user selects the scooter using the mobile application on their mobile device in step 310. For example, the user can scan a barcode or quick response code on the scooter. In step 312, the user places the footplate of their wheelchair on the deck of the scooter and moves forward to the limit switch or mechanical stop. Once the footplate contacts the mechanical stop, the user can indicate on the mobile application that the wheelchair is in position in step 314. In another example, when the limit switch or sensor is used, the controller of the scooter can receive signals from the limit switch or sensor that indicate that the footplate of the wheelchair is in contact with the mechanical stop.

Next, a hook/lever lifts from the scooter deck and clamps around a rear of the foot plate in step 316. Thus, the footplate of the wheelchair can be captured between the mechanical stop/stop mechanism and the hood/lever, which locks the wheelchair to the scooter.

When the hook/lever locks the wheelchair to the scooter, the controller of the scooter can unlock the adjustable tilt mechanism of the scooter in step 318. This allows the user to selectively adjust a tilt of the steering column of the scooter in step 320. Thus, the scooter can include a lock that is controlled by a solenoid or switch that is coupled with the processor. The controller can send signals that cause the lock on the steering column to activate or deactivate. As noted above, a lock is not always incorporated into the tilt adjustment mechanism.

Once the tilt of the steering column has been selected, the controller can raise a kickstand of the scooter (may be present in two-wheel scooter configurations) in step 322. The scooter is ready for use in step 324.

Figure 4:
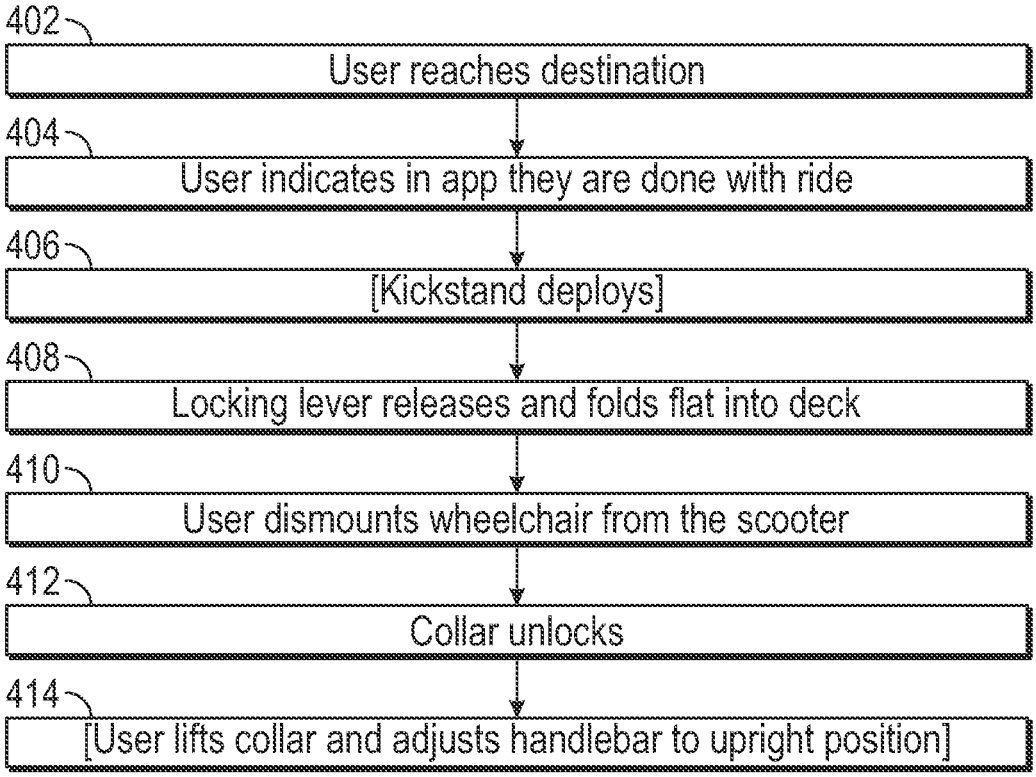
FIG. 4 is a flowchart of another example method of the present disclosure.

FIG. 4 is a flowchart of an example off-boarding method that is associated with the method of FIG. 3. The method can include a step 402 of the user reaching their destination. In step 404, the user indicates through their mobile application that their ride is complete. In step 406, the controller of the scooter can deploy the kickstand (if present) in response to the user indicating that their ride is complete. In step 408, the locking lever/hook releases and folds back into the deck of the scooter. This can include manual unlocking of the locking mechanism by the user or automated unlocking by the controller of the scooter.

In step 410, the user dismounts the wheelchair from the scooter. Also, unlocking of the locking mechanism can result in the controller of the scooter unlocking the tilt adjustment mechanism in step 412. The user can readjust the steering column to the upright position in step 414.

Figure 5:
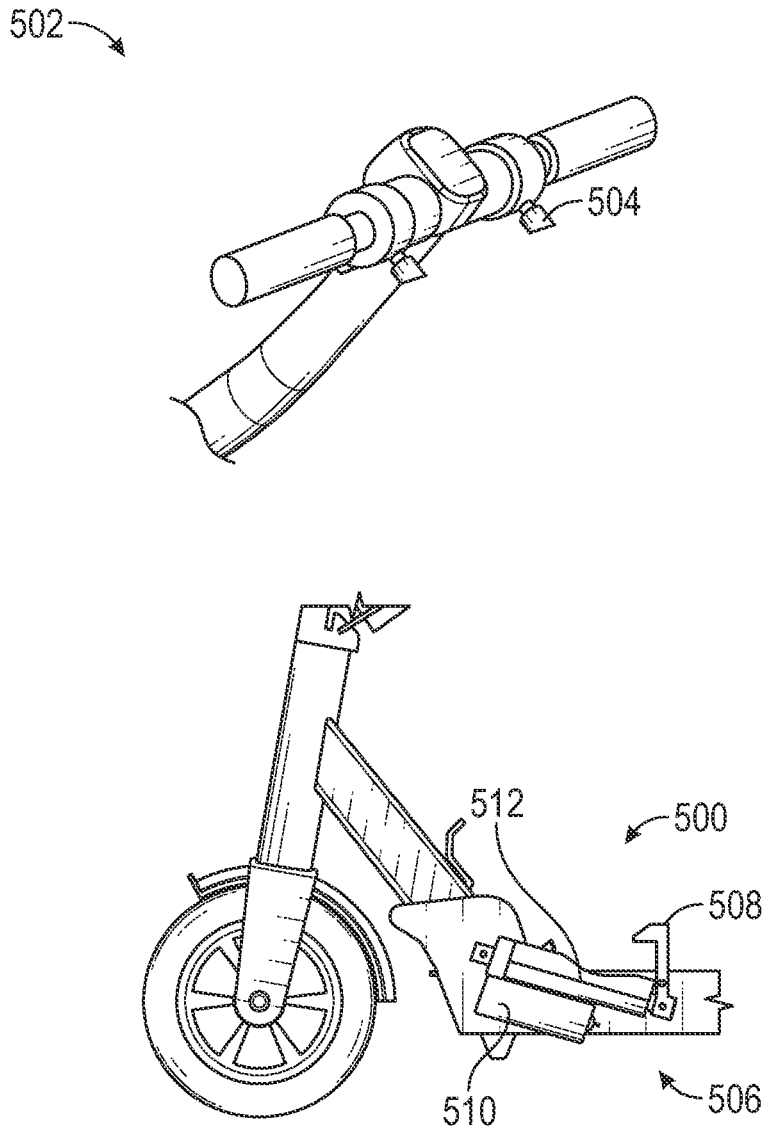
FIG. 5 is a perspective view of another example drive mechanism that can be incorporated as part of a locking mechanism.

FIG. 5 illustrates another example locking mechanism 500 that can be used with the scooter 102 of FIG. 1 in place of the manual locking mechanism (e.g., mechanical linkages). In this example, handlebars 502 can include an actuator 504, such as a switch, toggle, or button that is electrically coupled with a drive mechanism 506 (such as a linear actuator). The actuator 504 can also be coupled to a controller of the scooter. The controller receives signals from the actuator 504 and causes movement of the drive mechanism 506 in response.

The drive mechanism 506 can include a hook 508 that is moved between an open and closed position by manipulation of the actuator 504. The drive mechanism 506 can comprise a motor, solenoid, or pump 510 that drives a piston 512 coupled to the hook 508. In some instances, the operation of the drive mechanism 506 can be controlled through the use of a mobile application residing on a mobile device.

Implementations of the systems, apparatuses, devices and methods disclosed herein may comprise or utilize a special purpose or general-purpose computer including computer hardware, such as, for example, one or more processors and system memory, as discussed herein. Computer-executable instructions comprise, for example, instructions and data which, when executed at a processor, cause a general-purpose computer, special purpose computer, or special purpose processing device to perform a certain function or group of functions. An implementation of the devices, systems and methods disclosed herein may communicate over a computer network. A "network" is defined as one or more data links that enable the transport of electronic data between computer systems and/or modules and/or other electronic devices.

Although the subject matter has been described in language specific to structural features and/or methodological acts, it is to be understood that the subject matter defined in the appended claims may not necessarily be limited to the described features or acts described above. Rather, the described features and acts are disclosed as example forms of implementing the claims.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described exemplary embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A scooter comprising:

a scooter base that is configured to interface with a frame of a wheelchair;

a locking mechanism associated with the scooter base, the locking mechanism releasably securing the frame of the wheelchair to the scooter base;

a steering column associated with handlebars of the scooter; and a tilt adjustment mechanism coupled to the steering column, wherein the tilt adjustment mechanism comprises a lower collar that mates with a lower portion of the steering column and an upper collar that mates with an upper portion of the steering column, wherein the lower collar and the upper collar are resiliently coupled with one another in such a way that when a user pulls the upper collar away from the lower collar, the lower portion of the steering column and the upper portion of the steering column separate from one another allowing the steering column to pivot or tilt.

2. The scooter according to claim 1, wherein the lower collar comprises position grooves that correspond to tilt positions for the steering column.

3. The scooter according to claim 2, wherein when the user releases the upper collar, the upper collar is adapted to seat into one of the position grooves of the lower collar to secure the steering column in a tilted position.

4. The scooter according to claim 1, wherein the upper portion is divided into two sections that are coupled together via a u-joint.

5. The scooter according to claim 1, wherein the locking mechanism comprises a mechanical linkage assembly having a hook that is configured to engage with a footplate of the wheelchair, the mechanical linkage assembly comprises a first linkage having a handle, the first linkage being connected to a second linkage that is in turn coupled to a third linkage comprising the hook.

6. The scooter according to claim 1, further comprising a stop mechanism that engages with a footplate of the wheelchair.

7. The scooter according to claim 5, wherein the handle is used to move the hook from an open position to a closed position, wherein the hook is positioned proximately to a deck of the scooter base when in the closed position allowing the footplate of the wheelchair to move past the hook, the hook pivoting upwardly to engage with the frame or the footplate when in the closed position.

8. The scooter according to claim 1, wherein the locking mechanism comprises a linear actuator having a hook that is configured to engage with the frame of the wheelchair.

9. A scooter comprising:

a scooter base of the scooter that is adapted to interface with a frame of a wheelchair;

a locking mechanism associated with the scooter base, the locking mechanism releasably securing the frame of the wheelchair to the scooter base; and a controller comprising a processor and memory, the processor executing instructions stored in the memory to:

determine that a user has selected an accessibility setting for the scooter;

determine that the wheelchair is in an engagement position; and activate the locking mechanism to couple a hook with the frame of the wheelchair, wherein the processor executes the instructions to change a throttling profile for the scooter when the accessibility setting is selected.

10. The scooter according to claim 9, wherein the wheelchair is in the engagement position when the wheelchair contacts a limit switch associated with a stop mechanism.

11. The scooter according to claim 9, further comprising:

a steering column associated with handlebars of the scooter; and a tilt adjustment mechanism coupled to the steering column.

12. The scooter according to claim 11, wherein the tilt adjustment mechanism comprising a lower collar that mates with a lower portion of the steering column and an upper collar that mates with an upper portion of the steering column, wherein the lower collar and the upper collar are resiliently coupled with one another in such a way that when the user pulls the upper collar away from the lower collar, the lower portion of the steering column and the upper portion of the steering column separate from one another allowing the steering column to pivot or tilt.

13. The scooter according to claim 12, wherein the lower collar comprises position grooves that correspond to tilt positions for the steering column.

14. The scooter according to claim 13, wherein when the user releases the upper collar, the upper collar seats into one of the position grooves of the lower collar to secure the steering column in a tilted position.

15. The scooter according to claim 14, wherein a terminal end of the upper collar fits inside the lower collar so that the upper collar can rotate freely as the steering column is rotated by the user.

16. The scooter according to claim 9, wherein the locking mechanism comprises a mechanical linkage assembly including the hook that is configured to engage with the frame of the wheelchair, a first linkage having a handle, the first linkage being connected to a second linkage that is in turn coupled to a third linkage comprising the hook, wherein the handle is used to move the hook from an open position to a closed position, wherein the hook is positioned proximately to a deck of the scooter base when in the closed position allowing a footplate of the wheelchair to move past the hook, the hook pivoting upwardly to engage with the footplate in the closed position.

17. The scooter according to claim 9, further comprising a kickstand, the processor executing instructions stored in the memory to raise the kickstand when the locking mechanism is in a closed position and lower the kickstand before the locking mechanism is placed into an open position.

18. The scooter according to claim 17, wherein the processor is configured to unlock a tilt adjustment mechanism when the locking mechanism is in the closed position, allowing a steering column to tilt or pivot.

19. A scooter comprising:

a scooter base of the scooter that is adapted to interface with a frame of a wheelchair;

a locking mechanism associated with the scooter base, the locking mechanism releasably securing the frame of the wheelchair to the scooter base; and a controller comprising a processor and memory, the processor executing instructions stored in the memory to:

determine that a user has selected an accessibility setting for the scooter;

determine that the wheelchair is in an engagement position; and activate the locking mechanism to couple a hook with the frame of the wheelchair, wherein the wheelchair is in the engagement position when the wheelchair contacts a limit switch associated with a stop mechanism.

20. A scooter comprising:

a scooter base of the scooter that is adapted to interface with a frame of a wheelchair;

a locking mechanism associated with the scooter base, the locking mechanism releasably securing the frame of the wheelchair to the scooter base;

a kickstand; and a controller comprising a processor and memory, the processor executing instructions stored in the memory to:

determine that a user has selected an accessibility setting for the scooter;

determine that the wheelchair is in an engagement position;

activate the locking mechanism to couple a hook with the frame of the wheelchair; and raise the kickstand when the locking mechanism is in a closed position and lower the kickstand before the locking mechanism is placed into an open position.

* * * * *